United States Patent [19]

Tardivel et al.

[11] Patent Number: 4,556,391

[45] Date of Patent: Dec. 3, 1985

[54] INFLATABLE SHIP INTERIOR SIMULATING PLAY TENT

[76] Inventors: Georges M. Tardivel, Venice, Calif.; Monique M. Tardivel, P.O. Box 1174, 1601 Main St., Venice, Calif. 90291

[21] Appl. No.: 615,802

[22] Filed: May 31, 1984

[51] Int. Cl.[4] ..... A63H 17/00; A45F 1/16

[52] U.S. Cl. ..... 446/7; 446/478; 135/104

[58] Field of Search ..... 446/7, 82, 476, 478, 446/220, 225; 52/2; 272/16, 17; 434/29, 61; 135/104, 99

[56] References Cited

U.S. PATENT DOCUMENTS

| | | | |
|---|---|---|---|
| 2,475,515 | 7/1949 | Potter | 135/104 |
| 2,684,243 | 7/1954 | Alston | 272/17 |
| 2,855,701 | 10/1958 | Roos | 434/29 |
| 2,955,606 | 10/1960 | Walker | 52/2 |
| 3,387,412 | 6/1968 | Kwake | 135/104 |
| 3,486,242 | 12/1969 | Aronson | 434/29 |
| 3,618,256 | 11/1971 | Monks | 446/7 |
| 4,171,595 | 10/1979 | Tucker | 52/2 |
| 4,327,520 | 5/1982 | Saxby et al. | 135/98 |

*Primary Examiner*—Robert A. Hafer
*Assistant Examiner*—Daniel Nolan
*Attorney, Agent, or Firm*—Harvey B. Jacobson

[57] ABSTRACT

A downwardly opening canopy is provided and supported from an inflatable skeletal frame including a generally rectangular base portion and crossed-intersecting inflatable arch members. The canopy is constructed of translucent material and has an ocean ship sailing scene, in color, thereon with the scene being visible from within and from without the canopy. A yieldably supported pedestal is mounted within the area enclosed by the canopy and rotatably mounts a simulated ship's wheel therefrom. In addition, a compass pointer is rotatably journalled from the upper portion of the pedestal and the ship's wheel is drivingly connected to the compass needle for rotating the latter responsive to rotation of the ship's wheel. Also, water spray jet structure is disposed about the interior of the canopy and selectively operable by controls mounted atop the pedestal and a simulated mast is mounted in a central portion of the area enclosed by the canopy and includes lines supported therefrom which may be operated by children to simulate raising and lowering sails. Further, one wall portion of the canopy includes a rowing practice mechanism supported therefrom and the frame is closed at its bottom by a waterproof bottom wall having water outlet structure associated therewith spaced slightly above the bottom wall.

12 Claims, 14 Drawing Figures

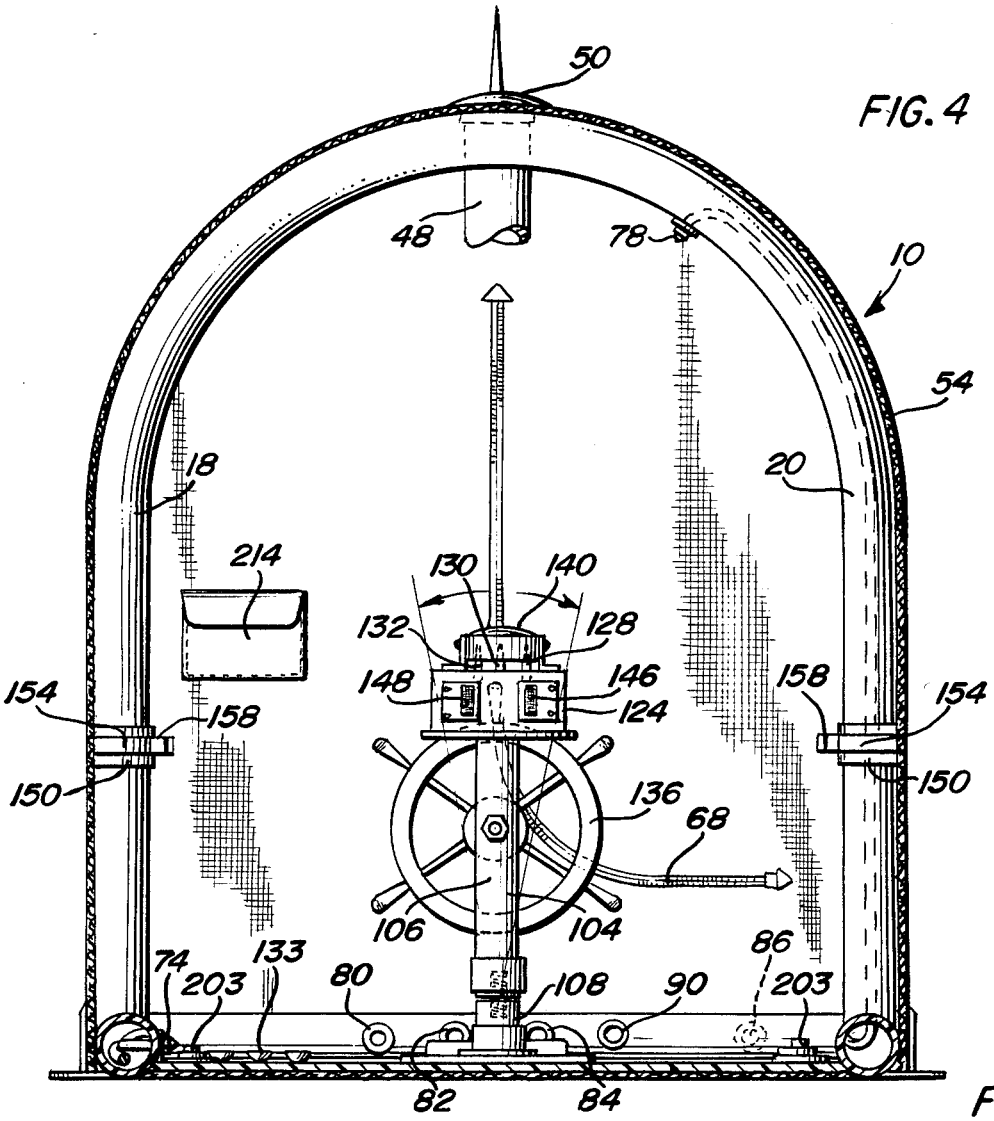
FIG. 4
FIG. 5
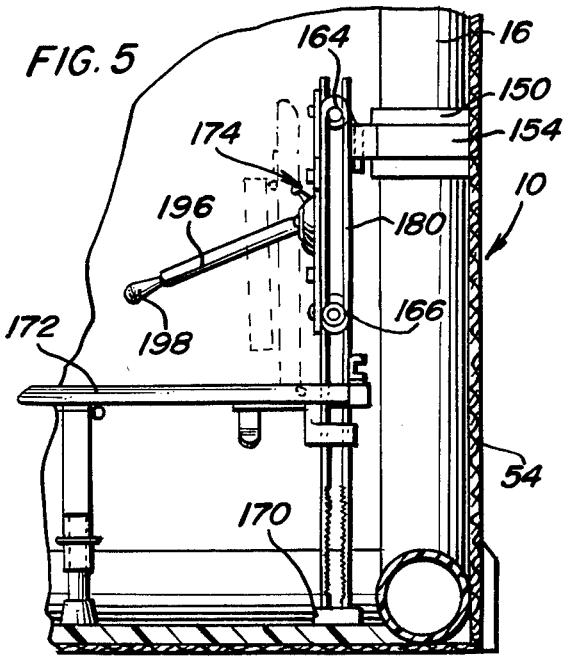
FIG. 9
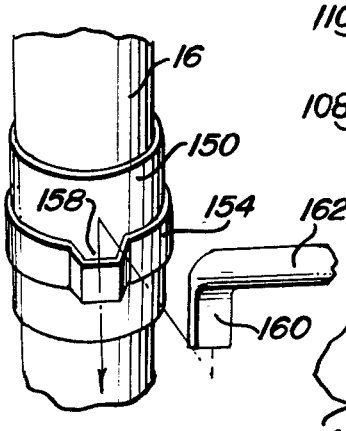
FIG. 10
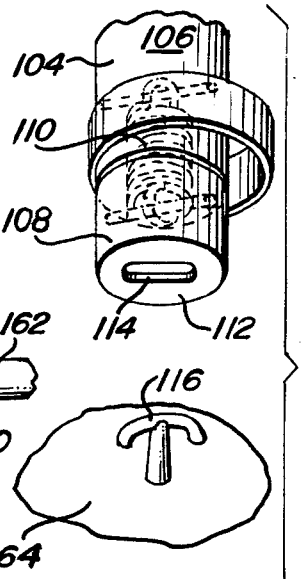

FIG. 7
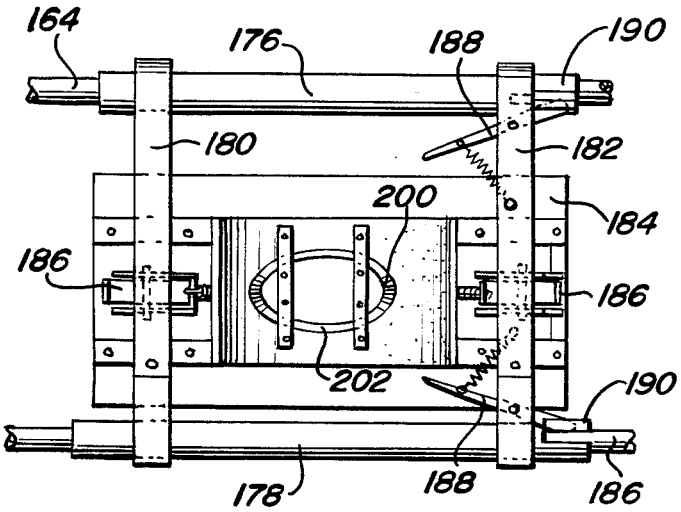
FIG. 12
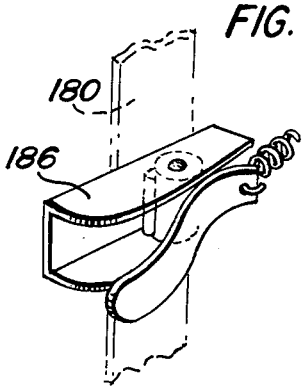
FIG. 8
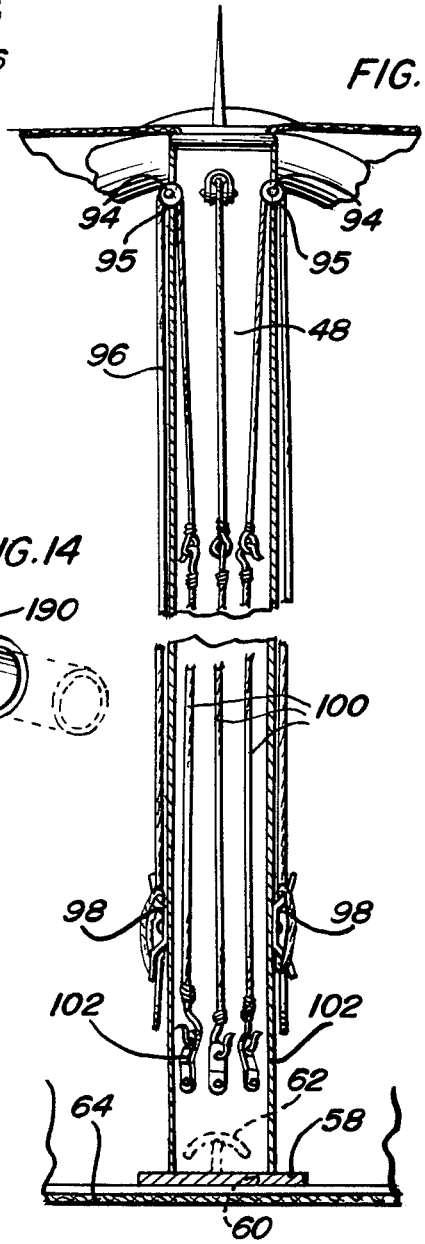
FIG. 11
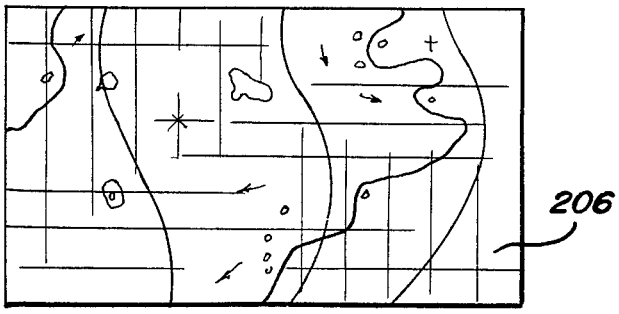
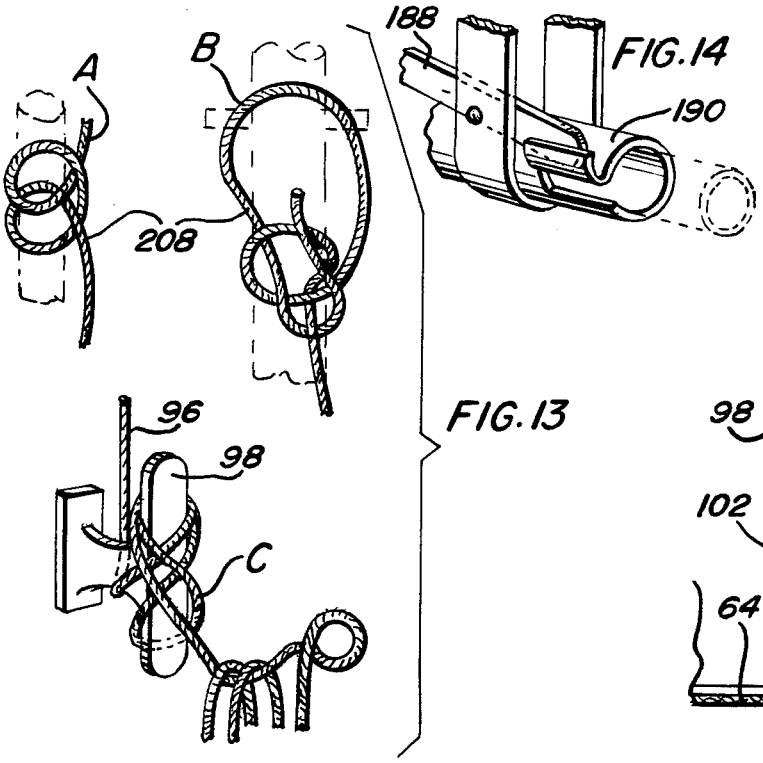
FIG. 14
FIG. 13

INFLATABLE SHIP INTERIOR SIMULATING PLAY TENT

BACKGROUND OF THE INVENTION

Various forms of play structures such as collapsible tents and other forms of travel simulating structures heretofore have been provided, but most of these play structures designed for use by children do not include sufficient features thereof promoting a high degree of usage of the imagination of children utilizing these structures.

Children's imagination can be considered nearly boundless and considerable character, intelligence, self-pride, independence, awareness and self-confidence development of children can be inhanced if those children are allowed to develop their imaginations. Accordingly, a need exists for a play environment which may be effective in promoting maximum use of children's imagination.

Examples of previously known devices including some of the general structural and operational features of the instant invention and which include structure designed to stimulate children's imagination to at least some extent are disclosed in U.S. Pat. Nos. 887,803, 892,070, 1,916,714, 2,684,243, 2,941,333, 3,315,959, 3,338,001, 3,712,438 and 4,068,418.

BRIEF DESCRIPTION OF THE INVENTION

The play tent of the instant invention is constructed in a manner which enables the tent to be readily erected and to be utilized by children in a substantially unsupervised manner. The play tent may be used to simulate shipboard environment relating to an ocean sailing ship and includes various internal structures which may be independently or simultaneously used to simulate various tasks which are carried out by different crew members of an ocean sailing ship.

The tent incorporates a canopy constructed of translucent material and having an ocean sailing scene printed thereon which may be viewed from both the exterior of the tent and the interior thereof. In addition, the tent interior includes a simulated mast having simulated sail halyards supported therefrom, a helmsman's pedestal having a compass supported therefrom as well as a helmsman's wheel journalled therefrom and the pointer of the compass is driven by the helmsman's wheel to indicate changes in direction of the "ship's" movement in relation to rotation of the helmsman's wheel. Still further, the interior of the tent supports a collapsible seat having a simulated rowing mechanism operatively associated therewith and the seat and rowing mechanism are adjustable according to the size of the child to be disposed on the seat. Still further, lengths of line are provided and may be used in conjunction with the simulated mast for practicing the tying of various different knots and the interior of the tent further includes variously arranged water spray jets for operative connection with a source of water under pressure (such as a domestic water hose) and under the control of selectively operable valves mounted on an upper portion of the aforementioned helmsman's pedestal.

The main object of this invention is to provide a play tent which may be used by children of various ages to simulate shipboard environment on an ocean sailing vessel.

Another object of this invention is to provide a play tent including numerous internal structures which may be used, in conjunction with the imagination of children within the tent, to simulate the tasks carried out by various different crew persons upon an ocean sailing vessel.

Still another object of this invention is to provide a play tent in accordance with the preceding objects and which will enable children of various ages to safely play therein and to use and develop their imagination as a result of such play.

A final object of this invention is to provide a play tent in accordance with the preceding objects and which will conform to conventional forms of manufacture, be of simple construction and easy to use so as to provide a device that will be economically feasible, long lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is an enlarged transverse vertical sectional view of the tent;

FIG. 5 is a fragmentary enlarged vertical sectional view of the tent illustrating the collapsible and adjustable seat structure therein as well as the attendant oar simulating structure;

FIG. 7 is an enlarged elevational view of the outer side of the oar simulating structure illustrated in FIG. 5;

FIG. 8 is a fragmentary enlarged vertical sectional view of the center portion of the tent illustrating mounting of the simulated mast and with center portions of the mast being broken away;

FIG. 9 is a fragmentary perspective view of one of the inflatable arch portions of the skeletal frame of the tent and illustrating the manner in which a support bracket is supported therefrom and a support member may be removably engaged with the support bracket;

FIG. 10 is a fragmentary perspective view of the lower end portion of the helmsman's pedestal in exploded position relative to the T-anchor carried by the bottom of the tent;

FIG. 11 is a plan view of a map which may accompany the tent for use by children using the tent;

FIG. 12 is an enlarged perspective view of the height adjusting lock for the oar simulating structure;

FIG. 13 comprises three fragmentary views illustrating three different ways line knotting and storing may be practiced; and FIG. 14 is a fragmentary perspective view of the structure by which horizontal adjustment of the oar simulating structure may be accomplished and retained.

DETAILED DESCRIPTION OF THE INVENTION

Figure 1:
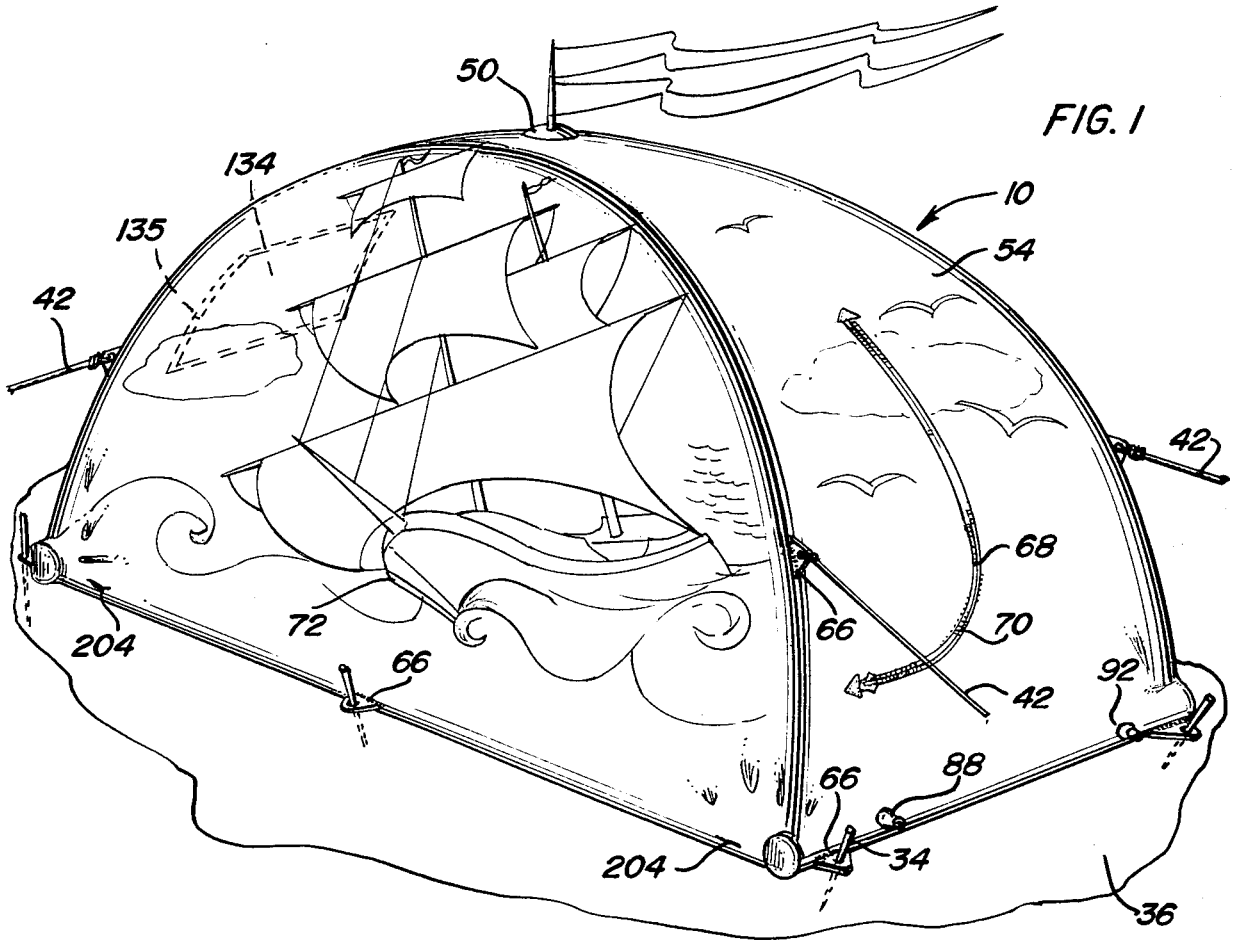
FIG. 1 is a perspective view of the play tent of the instant invention.
Figure 2:
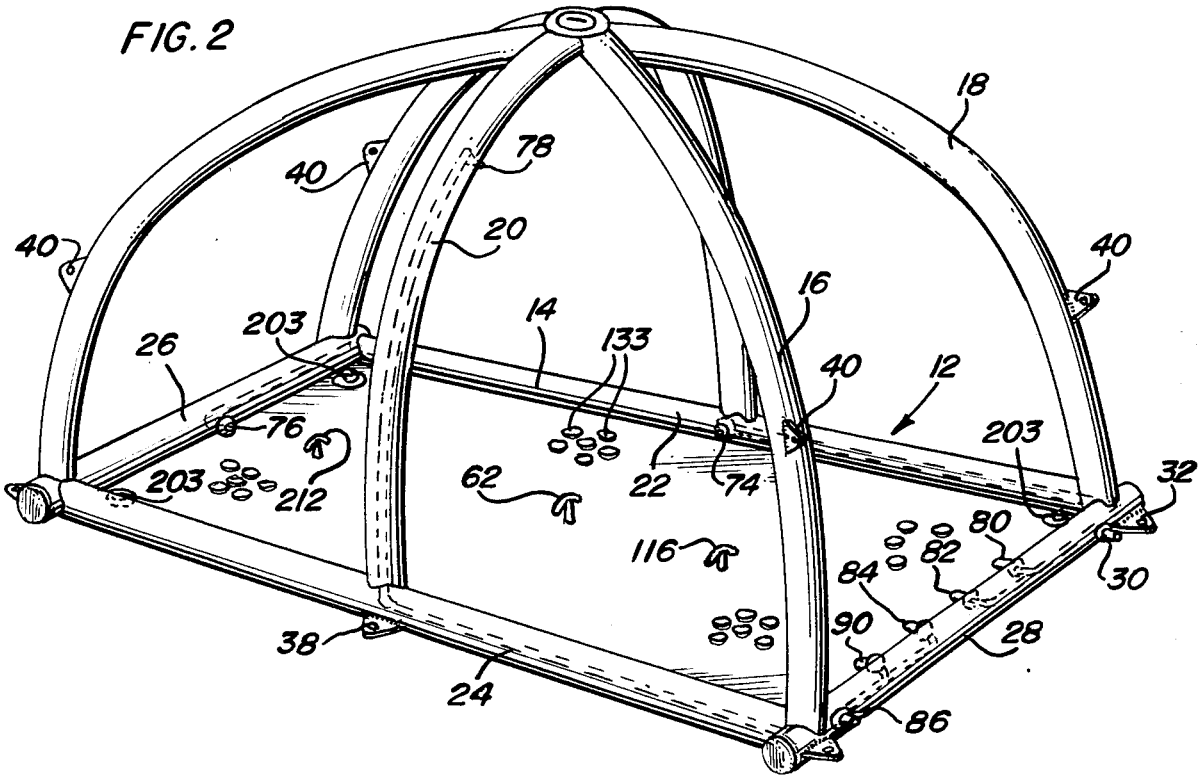
FIG. 2 is a perspective view of the play tent with the canopy portion thereof removed in order to clearly illustrate the inflatable skeletal frame of the tent which is used to support the canopy thereof.

Referring now more specifically to the drawings the numeral 10 generally designates the play tent of the instant invention. The tent 10 includes an inflatable tubular skeletal frame referred to in general by the reference numeral 12 and incorporating a generally rectangular base portion 14 as well as three intersecting and downwardly opening arch portions 16, 18 and 20. The base portion 14 includes opposite longitudinal side tubular members 22 and 24 and opposite end tubular members 26 and 28. The lower ends of the arch portions open into the tubular members of the base portion 14 for inflation therefrom and the transverse tubular member 28 includes an inflation valve 30 operatively associated therewith. In addition, opposite end portions of the tubular members 26 and 28 include horizontally outwardly projecting apertured tabs 32 through which ground spikes 34 may be passed in order to anchor the frame 12 to the ground 36 and the longitudinal midportions of the tubular members 22 and 24 include similar apertured tabs 38. Still further, each of the arch portions 16 and 18 include apertured anchor tabs 40 relative to which ground anchored lines 42 may be anchored.

Each arch portion 18 spans between diametrically opposite corner portions of the base portion 14 and the arch portion 20 spans between the mid-portions of the longitudinal tubular members 22 and 24. The uppermost intersecting portions of the arch portions 16, 18 and 20 define a vertical cylindrical passage 46 through the upper portion of the skeletal frame 12 and the upper portion of a tubular upright 48 simulating a ship's mast extends through the passage 46 and includes a flag-equipped cap 50 overlying the upper end of the passage 46. In addition, an O-ring seal 52 is provided about the upper end of the upright 48 immediately beneath the cap and seals relative to the central area of the downwardly opening flexible canopy 54 supported from the skeletal frame 12. The canopy includes a central opening 56 therein through which the upper end of the upright 48 extends, the seal 52 forming a fluid-tight seal between those portions of the canopy 54 defining the opening 56 and the upper end of the upright 48.

The lower end of the upright 48 includes a lower end fitting 58 having an elongated slot 60 formed therein through which a T-head anchor 62 mounted on and projecting upwardly from the floor 64 of the tent 10 extends. The floor 64 is of waterproof construction and spans across the bottom of the base portion 14 of the skeletal frame 12. In addition, the lower marginal portions of the canopy 54 are joined and sealed relative to the outer surfaces of the lower portion 14 of the skeletal framework 12 and the canopy 54 includes slots 66 formed therein through which the various tabs 32, 38 and 40 project. Still further, the canopy 54 includes an access opening 68 formed therein and removably closed by a zipper 70 and an ocean sailing vessel scene 72 printed on the canopy which may be viewed from the exterior of the canopy 54 as well as from the interior of the canopy 54, the canopy 54 being constructed of translucent material.

The longitudinal mid-portion of the longitudinal tubular member 22 includes an inwardly directed water spray jet 74 and the mid-portion of the transverse tubular member 26 includes a similar inwardly directed spray jet 76. Further, an upper portion of one leg of the arch portion 20 includes an inwardly and downwardly directed spray jet 78. The spray jets 74, 76 and 78 are connected by suitable supple and collapsible hoses to connector fittings 80, 82 and 84 opening inwardly through the tubular member 28 and a water inlet fitting 86 opens into the tubular member 28 from the exterior of the tent 10 through an opening 88 provided therefor in the canopy 54 and is communicated with a water outlet fitting 90 opening inwardly to the interior of the tent 10 from the tubular member 28, the inflation valve 30 opening outwardly through an opening 92 formed in the canopy 54.

The upright 48 includes a plurality of upper end pulley sheaves 94 supported therefrom, projecting through openings 95 provided therefore and spaced about the upright 48, and over which the mid-portions of a plurality of lines 96 simulating sail halyards are trained. One pair of corresponding ends of the lines 96 are snugged about cleats 98 supported from a lower portion of the upright 48 and the other set of ends of the lines 96 are connected to first ends of elastic members 100 including second ends removably anchored to anchor brackets 102 mounted within the lower end portion of the upright 48. Accordingly, children playing within the tent 10 may grasp one or more of the lines 96 and pull downwardly on the latter to simulate their use as halyards.

Figures 3, 6:
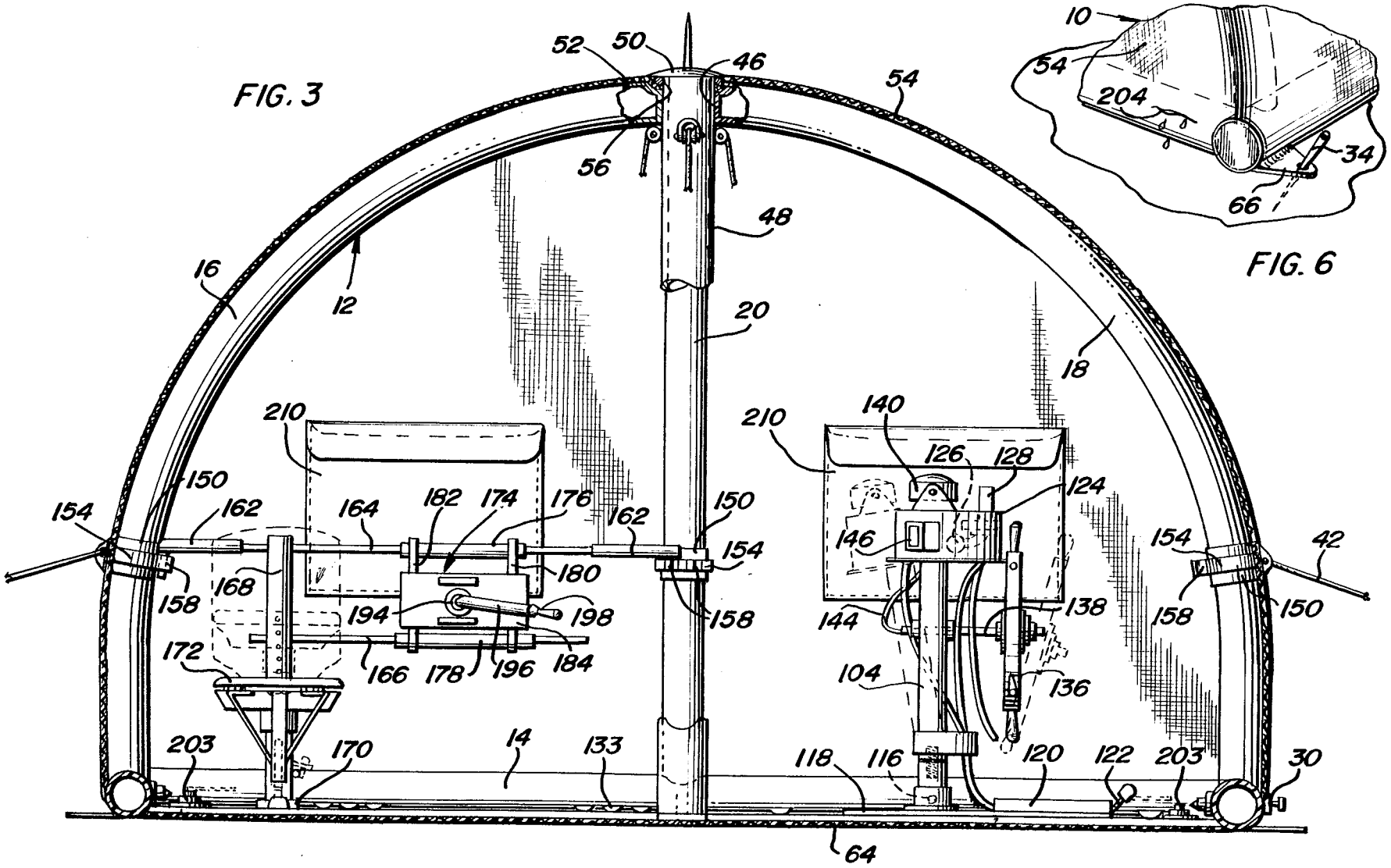
FIG. 3 is an enlarged fragmentary longitudinal vertical sectional view of the tent.
FIG. 6 is a fragmentary perspective view of one corner portion of the tent illustrating one ground anchor tab thereof and one water outlet slot formed in a lower marginal portion of the tent canopy.

With attention now invited more specifically to FIGS. 3, 4 and 10, it may be seen that an upright pedestal 104 is provided including upper and lower end portions 106 and 108 secured together through the utilization of a normally fully collapsed expansion spring 110 connected therebetween. The lower end portion 108 includes a bottom wall 112 having a slot 114 formed therein and the slot 114 is displaceable downwardly over the T-shaped anchor 116 provided therefor and supported from the bottom 64. After having been inserted downwardly over the anchor 116, the lower end portion 108 may be rotated approximately 90° in order to ensure against upward displacement of the pedestal 104 from the floor 64. The lower end portion 108 is supported from a base platform 118 disposed over the floor 64 and including a step-defining manifold 120 supported therefrom including four waterlines 122 extending therethrough. The four waterlines 122 are connected to the fittings 80, 82, 84 and 90 and the waterline connected to the fitting 90 extends upward to the enlarged head 124 carried by the upper end of the pedestal 104 and opens into a control manifold 126 supported from within the head 124. A plurality of independently operable valves 128, 130 and 132 are operatively connected to the manifold 126 and control the flow of water from the manifold 126 to the lines 122 connected to the fittings 80, 82 and 84.

The floor 64 includes upwardly opening suction cups 133 spaced thereover and the canopy 54 includes at least one window flap 134 removably closed by a zipper 135, see FIG. 1. Further, the upper portion 106 of the pedestal 104 has a helmsman's wheel 136 journalled from a horizontally outwardly projecting shaft 138 mounted from the upper portion 106 and a simulated compass 140 is mounted atop the head 124 and includes a compass pointer (not shown) to which the wheel 136 is drivingly connected through a flexible cable 144. In addition, the head 124 includes simulated port and starboard lights 146 and 148.

With attention now invited more specifically to FIGS. 3, 5 and 9 of the drawings, it may be seen that the arch portions 16, 18 and 20 include reinforcing bands 150 disposed thereabout over which formed mounting bands 154 are secured. The bands 154 define upwardly opening sockets 158 in which the downturned terminal ends 160 of the end portions 162 of a horizontal brace 164 are received (the band 154 on the arch portion 20 defining a pair of sockets 158). The brace 164 comprises an upper horizontal brace used in conjunction with a lower horizontal brace 166 having one end portion supported relative to an upright 168 having its upper end supported from the brace 164 and a fitting 170 on its lower end engaged with floor 64. The upright 168 adjustably vertically supports an upwardly collapsible hinge mounted seat 172 and a simulated oar mechanism referred to in general by the reference numeral 174 is mounted from the braces 164 and 166. The mechanism 174 includes upper and lower sleeves 176 and 178 slidable along the mid-portions of the braces 164 and 166 of the braces 164 and 166 and vertically disposed mounting straps 180 and 182 extending between corresponding ends of the sleeves 176 and 178 and guidingly supporting a mounting board 184 therefrom. The mounting board 184 includes spring-biased friction clamps 186 supported therefrom for clampingly engaging the mounting board in adjusted vertical positions along the straps 180 and 182. In addition, the strap 182 includes a pair of upper and lower spring-biased clamp levers 188 pivotally supported therefrom and the clamp lever 188 engage slotted end portions 190 of the sleeves 176 and 178 for releasably clampingly engaging the braces 164 and 166. Accordingly, the mounting board 184 may be adjusted both horizontally along the braces 164 and 166 and also vertically along the straps 180 and 182.

The mounting board 184 universally supports, at 194, the base end portion of an elongated simulated oar 196 at a location on the oar 196 spaced from the terminal end of the base end thereof and the oar 196 includes a handgrip defining free end 198, see FIG. 3. The terminal end of the oar 196 is illustrated as at 200 in FIG. 7 and is guidingly engaged in an elliptical guide slot 202 stationarily located relative to the mounting board 184. Accordingly, the handgrip end 198 of the oar 196 may be gripped by a person disposed on the seat 172 and oscillated in the manner in which an actual oar handgrip is oscillated during a rowing operation.

The bottom 64 is of watertight construction and sealed relative to the frame 12 and includes four openable corner drains 203 while the lower corner portions of the canopy 54 include horizontal water outlet slots 204 formed therein through which water tending to accumulate within the tent 10 may drain from the interior thereof. In addition, the tent 10 may include a nautical chart or map 206 as well as a length of rope or line 208. The line 208 may be used as at A and B in FIG. 13 to practice typing various knots on the upright 48 and the lines 96 may each be used relative to the corresponding cleats 98 in order to practice the proper manner of cinching the lines 96 relative to the cleats 98 and coiling and supporting the free ends of the lines 96 on the cleats 98 as illustrated at C in FIG. 13.

Also, the canopy 54 includes a pair of inner side flap equipped pockets 210, see FIG. 3, for receiving and keeping dry children's clothes and a smaller flap equipped pocket 214 see FIG. 4, for receiving and keeping dry a small tape player recording of the voice of an old sailor.

The universally supported pedestal 104 may be inclined from side-to-side by a child pretending to be an helmsman and the pretend helmsman may actuate the valve operators 128, 130 and 132 as desired in order to simulate water spray from different directions. In addition, the wheel 136 may be turned while watching the compass 140 in order to effect "changes in course" and other children within the tent may practice tying knots in lines, raising and lowering sails through utilization of the halyard simulating lines 96 and may sit on the seat 172 which simulates a seat on a dory or skiff adjacent an oar position thereon.

Thus it may be seen that children may use the tent 10 to the extent of their imagination and to develop the latter in wholesome play. The tent 10 may be used in sunny weather as well as rainy weather and in either instance the window flaps may be open or closed. Further, the tent itself including the canopy 54 and frame 12 are fully collapsible for compact storage and the entire assembly may be set up or broken down with minimum amount of effort.

A third floor anchor 2121 is provided for support of a pedestal table (not shown) therefrom with the pedestal portion thereof being similar to the lower end of pedestal 104 and thus universally anchored relative to the floor 64. Further, since the arch portion 20 band 154 defines a pair of sockets, a pair of simulated oars 196 and their supporting structure may be provided. Also, the edges of all metallic parts are rounded or include suitable plastic coverings or coatings (not shown).

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A play tent for children, said tent including an inflatable skeletal support frame, a downwardly opening canopy supported from said support frame, said canopy being at least light translucent and including access means for allowing ingress into and egress from the space enclosed within said canopy by children, an upright stanchion, mounting means mounting a lower portion of said stanchion within said space for limited universal angular displacement of said stanchion relative to said canopy, a ship's wheel journalled from said stanchion for rotation relative thereto about an axis generally normal to said stanchion, said skeletal support frame including a peripherally continuous lower base frame portion relative to which the lower marginal portion of said canopy is anchored, said base frame being generally quadrilateral in plan shape, said skeletal support frame also including a pair of crossed and interconnecting arch members each extending between diagonally opposite corner portions of said quadrilateral base frame portion, said canopy also including a bottom closing the lower portion of said space, a first pair of adjacent lower end portions of said arch members having a horizontal brace supported therefrom and extending therebetween, an upright seat support having upper and lower ends supported from said brace and bottom, a seat structure supported from said seat support and vertically adjustable there along, a mount mounted on said brace for adjustable positioning there along, and an elongated oar simulating handle including a first handgrip end and a second base end mounted from said mount for universal movement relative thereto.

2. The tent of claim 1 including water overflow outlet means for said space disposed at a predetermined distance above said bottom.

3. The tent of claim 2 including water spray jet means within said space and means for supplying water under pressure to said water spray jet means.

4. The tent of claim 2 wherein said access means is disposed above the elevation of said water outlet means.

5. The tent of claim 3 including control means carried by the upper end portion of said stanchion and operatively associated with said water spray jet means for selectively actuating and deactuating the latter.

6. The tent of claim 5 wherein said bottom also includes marginal portions anchored relative to said base frame portion.

7. The tent of claim 1 including a compass needle mounted from said stanchion for rotation about an upstanding axis, means drivingly connecting said ship's wheel to said compass needle for rotatably angularly displacing the latter responsive to rotatable angular displacement of said ship's wheel.

8. The tent of claim 1 wherein said water spray jet means includes water spray jets spaced about the periphery of said enclosed space.

9. The tent of claim 8 wherein said canopy includes an ocean sailing ship scene, in color, thereon, said scene being visible from within said canopy and from without said canopy.

10. A play tent for children, said tent including an inflatable skeletal support frame, a downwardly opening canopy supported from said support frame, said canopy being at least light translucent and including access means for allowing ingress into and egress from the space enclosed within said canopy by children, an upright stanchion, mounting means mounting a lower portion of said stanchion within said space for limited universal angular displacement of said stanchion relative to said canopy, a ship's wheel journalled from said stanchion for rotation relative thereto about an axis generally normal to said stanchion, water spray jet means for supply water under pressure to said water spray jet means, control means carried by the upper end portion of said stanchion and operatively associated with said water spray jet means for selectively actuating and deactuating the latter, said canopy including a watertight bottom closing the bottom of said canopy beneath said skeletal frame, water outlet means for said space disposed at a predetermined distance above said bottom, said bottom also including marginal portions anchored relative to said base frame portion, said base frame portion being generally quadrilateral in plan shape, said skeletal support frame including a pair of crossed and interconnected tubular arch members each extending between diagonally opposite corner portions of said quadrilateral base frame portion, said canopy and the interconnected portions of said tubular arch members being supported by a central upright, said central upright including a plurality of pulley sheaves journalled therefrom, a plurality of elongated tension members having mid-portions thereof trained over said sheaves, one set of end portions of said tension members comprising elastic sections thereof being anchored to the lower end portion of said central upright, the lower end portion of said central upright including a plurality of cleats supported therefrom, the other set of end portions of said tension members being removably cinched to said cleats.

11. A play tent for children, said tent including an inflatable skeletal-support frame, a downwardly opening canopy supported from said support frame, said canopy being at least light translucent and including access means for allowing ingress into and egress from the space enclosed within said canopy by children, an upright stanchion, mounting means mounting a lower portion of said stanchion within said space for limited universal angular displacement of said stanchion relative to said canopy, a ship's wheel journalled from said stanchion for rotation relative thereto about an axle generally normal to said stanchion, said skeletal support frame including a pair of crossed and interconnected tubular arch members each extending between diagonally opposite corner portions of said quadrilateral base frame portion, said canopy and the interconnected portions of said tubular arch members being supported by a central upright, said central upright including a plurality of pulley sheaves journalled therefrom, a plurality of elongated tension members having mid-portions thereof trained over said sheaves, one set of end portions of said tension members comprising elastic sections thereof being anchored to the lower end portion of said central upright, the lower end portion of said upright including a plurality of cleats supported therefrom, the other set of end portions of said tension members being removably cinched to said cleats.

12. The tent of claim 11 wherein said central upright being tubular, said sheaves being journalled in openings formed in and spaced about the upper end portion of said upright, said mid-portions of said tension members passing through said openings, said one set of end portions of said tension members being anchored to said upright within the latter.

* * * * *